United States Patent [19]

Cronkhite

[11] 4,359,296

[45] Nov. 16, 1982

[54] VIBRATOR FOR SCREED BOARDS

[76] Inventor: Daniel R. Cronkhite, Box 162B, R. R. 4, Danville, Ill. 61832

[21] Appl. No.: 232,226

[22] Filed: Feb. 6, 1981

[51] Int. Cl.[3] ..... E01C 19/38

[52] U.S. Cl. ..... 404/114

[58] Field of Search ..... 404/114; 74/87

[56] References Cited

U.S. PATENT DOCUMENTS

| | | | |
|---|---|---|---|
| 1,787,449 | 1/1931 | Jackson | 404/114 X |
| 2,306,126 | 12/1942 | Jackson | 404/114 |
| 2,314,985 | 3/1943 | Jackson | 404/114 |
| 2,542,979 | 2/1951 | Barnes | 404/114 |
| 2,584,459 | 2/1952 | Jackson | 404/114 |
| 2,599,330 | 6/1952 | Jackson | 404/114 |
| 4,073,593 | 2/1978 | Storm | 404/114 |

*Primary Examiner*—Nile C. Byers, Jr.

[57] ABSTRACT

An improved, portable, lightweight vibrator which is an integral unit and is easily and quickly removably secured to a screed board to vibrate it. Only a source of electrical power is required to operate it. Virtually any 2×4, 2×6 or larger boards of wood or metal such as aluminum or magnesium up to 20 feet in length can be used as the screed board. When properly installed on the screed board, the vibrator will walk or pull the screed board toward the rough pour, to save time and labor in leveling concrete.

10 Claims, 6 Drawing Figures

FIG. 1
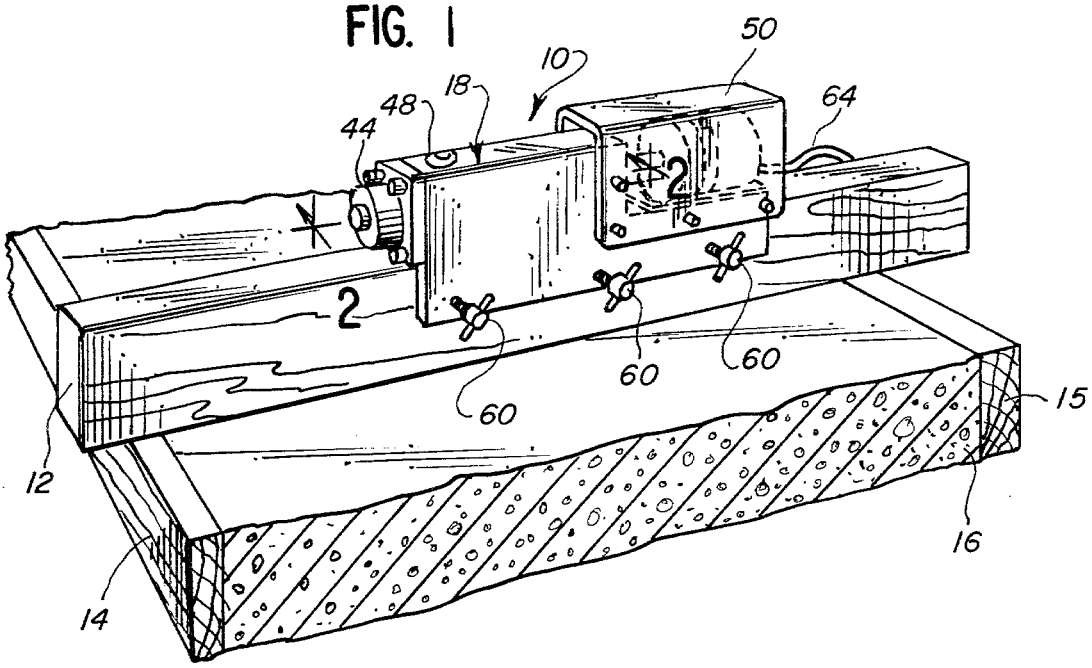
FIG. 2
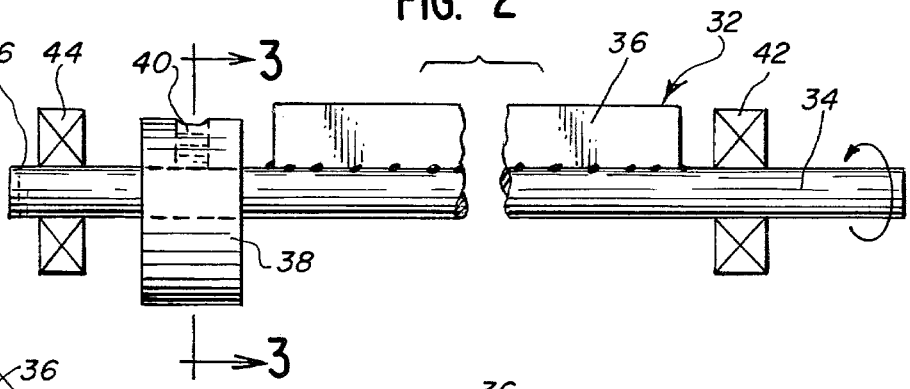
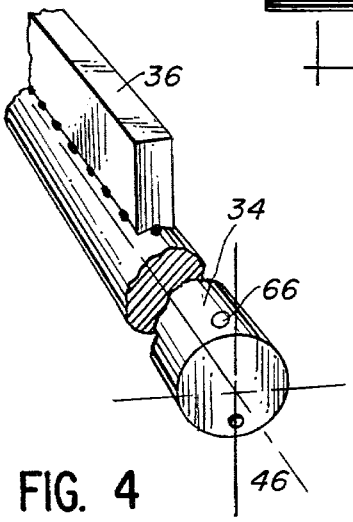
FIG. 4
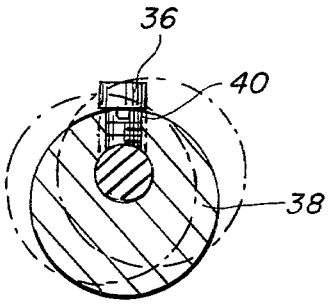
FIG. 3

FIG. 5
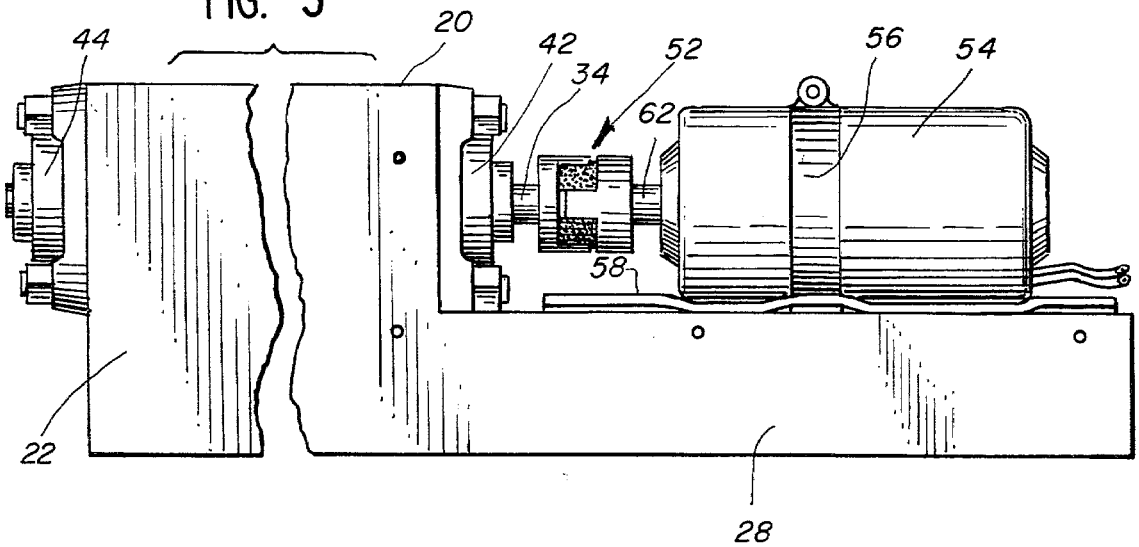
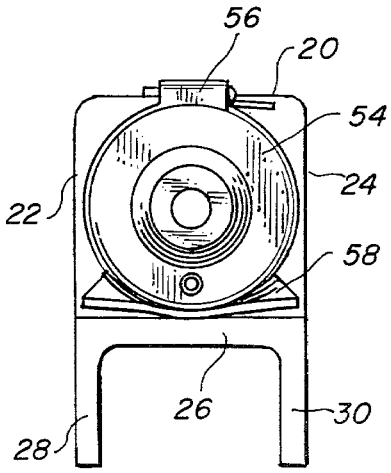
FIG. 6

VIBRATOR FOR SCREED BOARDS

Power screed boards and similar apparatus presently are commercially available, and the use of them for and in leveling, settling and/or compacting materials such as concrete is well known. Most, if not all, of the commercially available units are designed and constructed for heavy duty use by, for example, contractors who do a large volume of business. As a result, these units are generally expensive and are far too costly for the contractor who is called upon for an occasional job of laying a concrete patio or the like, and particularly, the handyman who wants to do his own work.

SUMMARY OF THE INVENTION

In U.S. Pat. No. 4,073,593 there is disclosed apparatus which can be easily and quickly removably secured to a length of board to convert or adapt the length of board to a power screed board so as to provide a relatively lightweight, inexpensive power screed board. The disclosed apparatus, while successful in the marketplace, is not entirely satisfactory and a demand for a similar but yet improved, more durable apparatus was created. In particular, many contractors realize the advantages of the disclosed apparatus, especially the portability and the lightweight features associated with it, but found the apparatus to be too spartan.

Accordingly, the disclosed, do-it-yourself apparatus has been completely redesigned to satisfy the needs of the many contractors who rejected it for one or another reason, and to provide an improved, portable, lightweight vibrator which these contractors now consider a valuable tool of the trade for concrete work. In particular, the vibrator of the present invention is an integral unit which is easily and quickly removably secured to a screed board to vibrate it, and only requires a source of electrical power to operate it. Virtually any 2×4, 2×6 or larger boards of wood or metal such as aluminum or magnesium up to 20 feet in length can be used as the screed board. When properly installed on the screed board, the vibrator will walk or pull the screed board toward the rough pour, to save time and labor in leveling concrete. Numerous other advantages are provided, as will be apparent from the description below.

OBJECTS OF THE INVENTION

Accordingly, it is an object of the present invention to provide an improved portable, lightweight vibrator which is adapted to be easily and quickly removably secured to a screed board for vibrating the screed board.

BRIEF DESCRIPTION OF THE DRAWINGS

For a fuller understanding of the nature and objects of the invention, reference should be had to the following detailed description, taken in connection with the accompanying drawings, in which:

FIG. 1 is a perspective view generally illustrating the portable, lightweight vibrator of the invention removably affixed to a screed board;

FIG. 2 is a side-plan view of the vibration element of the vibrator;

FIG. 3 is a sectional view taken along lines 3—3 of FIG. 2, and illustrating the manner in which the adjustable weight is adjusted to vary the amplitude of vibration of the vibrator;

FIG. 4 is a partial perspective view of the vibration element of FIG. 2;

FIG. 5 is a partial side-plan view of the portable, lightweight vibrator with its cover removed; and FIG. 6 is an end-plan view of the portable, lightweight vibrator with the cover thereof removed.

DETAILED DESCRIPTION OF THE PREFERRED EMBODIMENT

Referring now to the drawings, in FIG. 1 a portable, lightweight vibrator 10 exemplary of the present invention is illustrated affixed to a screed board 12. As illustrated, the vibrator 10 is used to vibrate the screed board 12 to level the concrete 16 contained between the forms 14 and 15. With the portable, lightweight vibrator 10, a pour can be leveled faster and easier than seesawing a screed board back and forth by hand. The vibrator 10 is designed to do any concrete job that normally would be done by hand, and it eliminates the hard work of screeding and jitterbugging. No longer do forms need to be hammered to settle the concrete, and it brings finishing paste to the surface without hand troweling.

More particularly, the portable, lightweight vibrator 10 is formed as an integral unit and includes a U-shaped housing 18 having a top wall 20, a pair of side walls 22 and 24, a bottom wall 26, which is longer in length than the top wall 20 and the side walls 22 and 24, and a pair of depending walls 28 and 30 below the bottom wall 26 and extending the length thereof. The bottom wall 26 is disposed between the top wall 20 and the side walls 22 and 24 and provides a cavity for receiving therein a vibration element 32. The vibration element 32 which is described more particularly below, is supported within the cavity by means of a pair of bearing assemblies 42 and 44.

The vibration element 32 includes a main drive shaft 34 to which is fixedly secured a weight element 36. A randomly adjustable weight 38 of a generally cylindrical shape is eccentrically secured about the main drive shaft 34 and is adjustably fixedly secured to the main drive shaft 34 by means of a set screw 40. The main drive shaft 34, as can be best seen in FIG. 4, has a punch mark 46 formed in it for providing indicia for adjusting the amplitude of vibration of the vibrator 10, as more particularly described below.

As can be best seen in FIG. 5, a coupling element 52 is affixed to the main drive shaft 34 of the vibration element 32 and to the drive shaft 62 of an electrical motor 54. A damping element 58, which may be, for example, a length of belt strapping, is disposed beneath the motor 54 to dampen the vibration and to cushion the electrical motor 54. The electric motor 54 is secured to the bottom wall 26 of the housing 18 by means of an adjustable clamp 56. A cover 50 is secured to the housing 18 to enclose the motor 50 to protect and shield it from dirt, grime, concrete and the like. The housing 18 also has an aperture in its top wall 20 which is normally sealed by a rubber plug 48 or the like, which rubber plug 48 is removable to permit the randomly adjustable weight to be adjustably positioned on the main drive shaft 34 of the vibration element, as more particularly described below. A number of thumb screw clamps 60 are threadedly affixed to one or the other or both of the depending walls 28 and 30 for removably affixing the vibrator 10 to a screed board.

To utilize the portable, lightweight vibrator 10, preferably it is mounted in the middle of a 2×6 screed board up to 20 feet in length. As indicated above, the screed board may be wood, aluminum or magnesium. The vibrator 10 should be placed on the screed board so that the thumb screw clamps 60 are on the back side and the power cord 64 of the electric motor is on the right side as the operator is facing the vibrator 10. When attached to the screed board in this position, the vibrator 10 will walk or pull the screed board toward the rough pour. The vibrator 10 is installed on the screed board 12 simply by disposing the latter between the depending walls 28 and 30 of the housing 18, and by tightening the thumb screw clamps 60 securely. The electric motor 50 then is simply coupled to a source of electrical power (not shown) by means of the power cord 64.

The amplitude or strength of vibration of the vibrator 10 is easily and quickly adjusted by first unplugging the power cord 64 from the source of electrical power. The rubber plug 48 then is removed, and a screwdriver or similar type of instrument is inserted in the hole 66 in the main drive shaft 34, and the main drive shaft 34 rotated, until the set screw 40 in the randomly adjustable weight 38 is in view through the aperture 48 in the top wall of the housing 18. The set screw 40 then is loosened with an allen wrench or the like, and the allen wrench is left in the set screw 40 to prevent the randomly adjustable weight 38 from turning. The main drive shaft 34 then is rotated to the desired output, using the punch mark 46 on the end of the main drive shaft 34 as a visual indicator of the adjustment being made. When the punch mark 46 points downward towards the bottom of the vibrator 10, the maximum amplitude or strength of vibration of the vibrator 10 will be provided. Rotating the main drive shaft 34 in either direction from maximum output will decrease the strength of the output. When the punch mark 46 points to the top of the vibrator 10, the vibrator 10 will be at its minimum output. When at the desired amplitude, the set screw 40 is again tightened to fixedly secure the randomly adjustable weight 38 to the main drive shaft 34, and the rubber plug 48 is replaced.

From the above description, it will be seen that the objects set forth above, along with those made apparent from the preceding description, are efficiently attained, and certain changes may be made in the construction set forth. Accordingly, it is intended that all matter contained in the above description or shown in the accompanying drawings shall be interpreted as an illustrative and not in a limiting sense.

Now that the invention has been described, what is claimed as new and desired to be secured by Letters Patent is:

1. A portable, lightweight vibrator adapted to be easily and quickly removably secured to a screed board for vibrating the screed board comprising:

a generally U-shaped integrally formed housing having a top wall and a pair of side walls, a bottom wall longer in length than said top and pair of side walls, and a pair of depending walls below said bottom wall and extending the length thereof, said bottom wall being disposed between said top and pair of side walls and providing a cavity for receiving therein a vibration element, said pair of depending walls forming a channel for receiving therein a screed board to which said vibrator is to be removably secured; means carried by said depending walls for clamping said vibrator to a screed board disposed with said channel; said vibration element comprising an unbalanced rotating element disposed and rotatably supported within said cavity; a source of power for rotatably driving said vibration element secured to said bottom wall and coupled to said vibration element; and a generally U-shaped cover disposed about said source of power and secured to said housing.

2. The portable, lightweight vibrator of claim 1, further comprising a randomly adjustable weight operatively associated with said unbalanced rotating element for varying the amplitude of vibration of said vibration element.

3. The portable, lightweight vibrator of claim 2, wherein said randomly adjustable weight comprises weight means eccentrically affixed to said unbalanced rotating element; locking means carried by said weight means for adjustably affixing said weight means to said rotating element; an aperture in said housing for permitting access to said locking means to adjustably position and to affix said weight means to said rotating element in selective operative positions to vary the amplitude of vibration of said vibrator.

4. The portable, lightweight vibrator of claim 3, further comprising means for closing said aperture in said housing to prevent dirt and the like from said cavity.

5. The portable, lightweight vibrator of claim 3, further comprising indicia associated with said weight means and said rotating element for indicating the degree of the amplitude of vibration of said vibrator in various selective positions.

6. The portable, lightweight vibrator of claim 3, wherein said means for clamping said vibrator to a screed board comprises a plurality of thumb screw clamps threadedly disposed in at least one of said depending walls.

7. The portable, lightweight vibrator of claim 1, wherein said source of power comprises an electric motor means.

8. The portable, lightweight vibrator of claim 7, further comprising a resilient pad affixed to said bottom wall for protecting said source of power, and means for detachably clamping said source of power to said bottom wall atop said resilient pad.

9. The portable, lightweight vibrator of claim 1, further comprising a plurality of air cooling vents in said cover.

10. The portable, lightweight vibrator of claim 1, wherein said housing is extruded of aluminum.

* * * * *